US011002160B2

(12) United States Patent
Hattiangadi et al.

(10) Patent No.: US 11,002,160 B2
(45) Date of Patent: May 11, 2021

(54) LIFTER PROVIDING IMPROVED CAM LOBE LUBRICATION

(71) Applicant: CATERPILLAR INC., Peoria, IL (US)

(72) Inventors: Ashwin A. Hattiangadi, Edwards, IL (US); John Stephen Pipis, Jr., Washington, IL (US); Charles Francis Coffey, Peoria, IL (US); Kevin Duane Yoder, Peoria Heights, IL (US); Vaibhav Balaji, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/547,713

(22) Filed: Aug. 22, 2019

(65) Prior Publication Data

US 2021/0054767 A1 Feb. 25, 2021

(51) Int. Cl.

| | |
|---|---|
| ***F01L 3/08*** | (2006.01) |
| ***F01L 1/04*** | (2006.01) |
| ***F01L 1/08*** | (2006.01) |
| ***F01L 1/047*** | (2006.01) |
| *F01L 3/00* | (2006.01) |

(52) U.S. Cl.

CPC ..... *F01L 3/08* (2013.01); *F01L 1/047* (2013.01); *F01L 1/08* (2013.01); *F01L 2003/11* (2013.01); *F01L 2305/02* (2020.05)

(58) Field of Classification Search

CPC ..... F01L 3/08; F01L 1/047; F01L 1/08; F01L 2305/02; F01L 2003/11

See application file for complete search history.

(56) References Cited

U.S. PATENT DOCUMENTS

| | | | | |
|---|---|---|---|---|
| 2,313,264 | A | 3/1943 | Reggio | |
| 6,220,758 | B1 | 4/2001 | Ono et al. | |
| 6,357,407 | B2 | 3/2002 | Brothers | |
| 7,878,169 | B2 | 2/2011 | Brinks | |
| 9,222,376 | B2 | 12/2015 | Massing et al. | |
| 2012/0152196 | A1 | 6/2012 | Langewisch et al. | |
| 2012/0174887 | A1 | 7/2012 | Bartkowicz et al. | |
| 2015/0369097 | A1 | 12/2015 | Hauvespre et al. | |
| 2016/0230610 | A1* | 8/2016 | Berruet | F04B 1/0417 |
| 2016/0319708 | A1 | 11/2016 | Nielsen | |

FOREIGN PATENT DOCUMENTS

| | | |
|---|---|---|
| CN | 201786403 | 4/2011 |
| DE | 102011084486 | 4/2013 |
| EP | 3002426 | 11/2017 |
| JP | H11200989 | 7/1999 |

* cited by examiner

*Primary Examiner* — Jacob M Amick

(74) *Attorney, Agent, or Firm* — Hibshman Claim Construction PLLC

(57) ABSTRACT

A cam follower assembly includes a cam roller, and a generally cylindrical body having an outer peripheral surface configured to be reciprocally slidable within a bore of an engine component. The cam roller is rotatably mounted on the body and configured to engage with a cam lobe on a camshaft of the engine. The cam lobe is operative to drive the body to a position at which the cam follower assembly causes one of opening of a valve or actuation of a fuel injector of the engine. A groove is formed in the body inset from the outer peripheral surface and extending axially along the outer peripheral surface parallel to the longitudinal axis of the body and aligned with an axial median plane of the cam roller and the cam lobe.

18 Claims, 11 Drawing Sheets

LIFTER PROVIDING IMPROVED CAM LOBE LUBRICATION

TECHNICAL FIELD

The present disclosure relates generally to a lifter used in engines and fuel pumps, and more particularly, to a lifter providing improved cam lobe lubrication.

BACKGROUND

Flow control components of an internal combustion engine such as intake and exhaust valves and fuel injectors are typically driven by a cam arrangement that is operably connected to a crankshaft of the engine. Rotation of the crankshaft results in a corresponding rotation of a camshaft that drives one or more cam followers or lifters. The movement of the lifters results in reciprocating motion of the intake and exhaust valves and actuation of the fuel injectors. The shape of cam lobes on the camshaft governs the timing and duration of opening and closing of the intake and exhaust valves and of the fuel injection. Each lifter may include, among other things, a cam roller in contact with a cam lobe of the camshaft, and a bushing, roller bearing, or needle bearing that rotatably supports the cam roller at one end of a body of the lifter.

Conventional camshaft internal combustion engines typically utilize valve lifters, push rods, and valve springs along with rocker arms to open and close the intake and exhaust valves of the engine to allow air and fuel to enter and exhaust to exit the cylinders of the engine during combustion. These components are collectively referred to as the "valve train." In conventional cam engines as opposed to those of overhead design, a valve lifter with a pushrod rides on the cam lobes of the camshaft, which is rotated by the crankshaft. As the lifter reciprocates up and down, the push rod seated in the lifter also reciprocates and communicates this up and down motion via a rocker arm to either an intake or exhaust valve. A high tension spring ranging from approximately 200 to 1000 lbs/inch, surrounds the stem of the valve and when the spring is compressed, the valve is pushed into the cylinder. During the up stroke of the piston in the cylinder, the intake valve opens to allow fuel and air to enter the combustion chamber. Somewhere near the very top of the up stroke, both the intake and the exhaust valves close and the spark plug creates a spark to ignite the air-fuel mixture which is under compression by the piston. This results in a high temperature explosion which forces the piston downward, called the "power stroke," thereby translating this movement via a connection rod to rotate the crankshaft which, in turn, translates this angular motion to the wheels of the vehicle via a set of gears. Near the bottom of the power stroke, the exhaust valve opens to expel the burnt fuel mixture out of the cylinder. After the piston changes directions and begins the up stroke, the exhaust valve continues to remain open, thereby forcing any remaining spent gases out of the cylinder. However, during this same time, the intake valve begins to open to recharge the cylinder with fuel. It is not until the piston has started to travel upward that the exhaust valve closes. Thus, at various times during the compression cycle, both the intake and exhaust valves will be open and closed at the same time. The timing of the opening and closing of the valves is controlled by the physical design of the oval shaped cam lobes on the camshaft. As the valve lifter is pushed upward by the cam lobe of the camshaft, the valve lifter pushes the pushrod up which drives the rocker arm downward, causing the valve to open.

Likewise, as the lifter and pushrod travel downward, the rocker arm raises and the valve closes due to the biasing action of the valve spring.

In high speed engines, characterized by a high number of revolutions per minute (RPM), the valve train components are under extreme stress and high temperatures. To increase engine performance and decrease component wear that may eventually lead to failure, various valve lifter configurations have been designed. Solid and hydraulic valve lifters are the most common designs used in conventional cam engines. Hydraulic lifters are typically used in relatively low RPM engines, up to 6,500 RPM, whereas solid valve lifter designs are preferred in high RPM applications such as racing and high performance applications. Conventional hydraulic and solid lifters have a flat surface that is fixed or integral with the body of the lifter and is adapted to engage and ride on the cam lobes of the camshaft. The engagement between the fixed surface of the lifter body and the camshaft lobe creates high frictional forces, causing the surfaces of the lobes to wear. Therefore, the higher the RPM of the engine, the greater the wear and the likelihood of material being removed from the cam lobe. As material is removed from the surface of the cam lobe, the timing of the opening and closing of the valve also changes. This change in timing may hamper engine performance such as by allowing excess fuel to enter the cylinder causing a rich condition. Conversely, improper timing may permit air-fuel mixture that has not been completely combusted to escape through the exhaust valve which results in a lean condition, increased fuel consumption, and increased pollution. Either of these conditions will affect cylinder pressure and decrease performance and may cause misfiring of the cylinder and engine damage. Furthermore, if this improper timing allows a valve to remain open when the piston is near the top of the compression stroke, the piston will strike the valve resulting in bent pushrods and valves, broken valve springs and lifters and will eventually lead to catastrophic engine failure.

To decrease cam lobe wear in high performance engines, a cam roller has been added to the body of the valve lifter for riding on the cam lobe of the camshaft. The cam roller allows the use of a camshaft with cam lobes having steeper ramp angles to provide faster valve opening and closing for accommodating high RPM engines. The cam roller engagement with the rotating cam lobe reduces the frictional forces generated therebetween. Not only does the presence of the cam roller decrease cam lobe and valve lifter wear, it also provides smoother transitions as the cam roller travels over the peak of the cam lobe, thereby decreasing valve train noise. Likewise, various bearing and sleeve configurations have been utilized to decrease friction and wear of the shaft rotatably mounting the cam roller to the valve lifter. For high performance engines, needle bearings have replaced solid cam rollers, cam roller bushings, and conventional ball bearings to decrease wear and more evenly spread the load over the surface of the shaft. However, even with cam rollers that include bearings or bushings, proper functioning of a cam roller and cam roller-to-cam lobe interface depends on a continuous supply of a lubricant to the cam roller and to the interface with a cam lobe. From the ground up, a typical engine is configured with an oil pan for holding oil and an oil pump that feeds the oil to various locations in the engine. Above the oil pan sits the engine block and the crankshaft, such that a portion of the crank rotates in the oil. In a typical "V"-style engine, that is, one having cylinders at an angle to the left and right sides of the block in a "V" pattern with the crankshaft positioned at the apex of the "V", the camshaft is typically located directly above and in parallel with the crank. In straight cylinder configuration engines wherein all cylinders are aligned in a row, the crankshaft and cylinders are located in the same plane and camshaft is positioned to one side so as to not interfere with the travel of the connecting rods. The valve lifters in an "V" style engine are located in a lifter galley. The lifters are lubricated by oil in the engine block and receive direct lubrication from one or more transverse oil passageways in the engine block that intersect the bores in which the valve lifters are positioned and indirectly from oil that is sprayed into the lifter galley from the rotation of the crankshaft and connecting rods. Various methods have been employed to increase the lubrication of the valve lifters and camshaft. One method used to increase the movement of oil to the valve lifters and camshaft is the addition of small holes to the crankshaft and the dynamic balance weights of the crank. These holes, or oil squirters, pickup oil from the pan and any oil on the surface of the crank and throw the oil to the camshaft and valve lifter as the crankshaft and rotates. This method is also employed in engines having steel connecting rods to lubricate the cylinder wall by placing a through-hole on the end that connects to the piston and to the lifters by adding a squirter to the "big end" or end that connects to the crankshaft. However, the machining of the oil squirter reduces the strength of the crankshaft and has been found to severely weaken aluminum connecting rods used in high performance, high RPM engines.

Another method of directing oil to the lifters and camshaft involves adding separate oil feed lines to the lifter galley. This is accomplished by drilling a feed hole into an oil passageway of the engine block to tap the oil pressurized by the oil pump and adding metal tubing to direct the oil to the desired location such as above the camshaft. However, adding components to the internals of engine is not always practical due to the limited amount of space. Furthermore, these added components may also fail and create shrapnel that will be run through the engine which can damage precision surfaces such as on the camshaft, crankshaft, pistons, etc.

An exemplary cam follower is disclosed in U.S. Pat. No. 9,222,376 that issued to Massing et al. on Dec. 29, 2015 ("the '376 patent"). Specifically, the '376 patent discloses a cam follower including a tappet (lifter body) positioned between a cylinder valve and a camshaft, with the tappet configured to drive the cylinder valve, a cam roller, and a pin coated with a diamond-like carbon coating that couples the roller to the tappet. The pin is provided with a depressed contour on an outer surface of the pin. The depressed contour on the pin purportedly reduces edge loading due to concentrated contact between the pin and the cam roller.

Although the cam follower of the '376 patent may be suitable for some applications, it may still be less than optimal. For example, the structure disclosed in the '376 patent is intended to reduce wear and degradation of the pin that couples the cam roller to the tappet, but does not do anything to improve the lubrication of the high load surfaces at the interface between the cam roller and the cam lobe.

The lifter of the present disclosure is directed towards overcoming one or more of the problems set forth above and/or other problems of the prior art.

SUMMARY OF THE DISCLOSURE

One aspect of the present disclosure is directed to a cam follower assembly including a cam roller. The cam follower assembly may include a generally cylindrical body having an outer peripheral surface configured to be reciprocally slidable within a bore of an engine component. The body rotatably mounts the cam roller with the cam roller being configured to engage with a cam lobe on a camshaft of the engine, wherein the cam lobe is operative to drive the body to a position at which the cam follower assembly causes one of opening of a valve or actuation of a fuel injector of the engine. A groove is formed in the body inset from the outer peripheral surface and extending axially along the outer peripheral surface parallel to the longitudinal axis of the body and aligned with an axial median plane of the cam roller and the cam lobe.

Another aspect of the present disclosure is directed to a lifter configured for use in an engine including a plurality of flow control components and a camshaft including cams that cause reciprocating movement of the flow control components. The lifter may include a generally cylindrical body having an outer peripheral surface configured to be reciprocally slidable within a bore of an engine component. The body may rotatably mount a cam roller with the cam roller being configured to engage with a cam lobe on the camshaft of the engine, wherein the cam lobe is operative to drive the body to a position at which the lifter causes one of opening of a valve or actuation of a fuel injector of the engine. An oiling channel may be formed in the body inset from the outer peripheral surface and extending axially along the outer peripheral surface parallel to the longitudinal axis of the body and aligned with an axial median plane of the cam roller and the cam lobe.

In yet another aspect, the present disclosure is directed to a method of supplying oil to a high load area on at least one of a cam roller of a lifter or a cam lobe of a camshaft including cams that cause reciprocating movement of the lifter and flow control components of an engine, wherein the lifter may include a generally cylindrical body having an outer peripheral surface configured to be reciprocally slidable within a bore of an engine component, the cam roller may be rotatably mounted on the body and configured to engage with the cam lobe, and the cam lobe may be operative to drive the body to a position at which the lifter causes movement of at least one of the flow control components. The method may include receiving oil from an oil supply passageway of the engine component into an oil receiving annular recess formed around the outer peripheral surface of the body at a location spaced from the cam roller while the body is reciprocally sliding within the bore of the engine component, and directing the oil from the oil receiving annular recess into an oiling channel formed in the body inset from the outer peripheral surface and extending axially along the outer peripheral surface parallel to the longitudinal axis of the body and aligned with an axial median plane of the cam roller and the cam lobe.

DETAILED DESCRIPTION

Figure 1A:
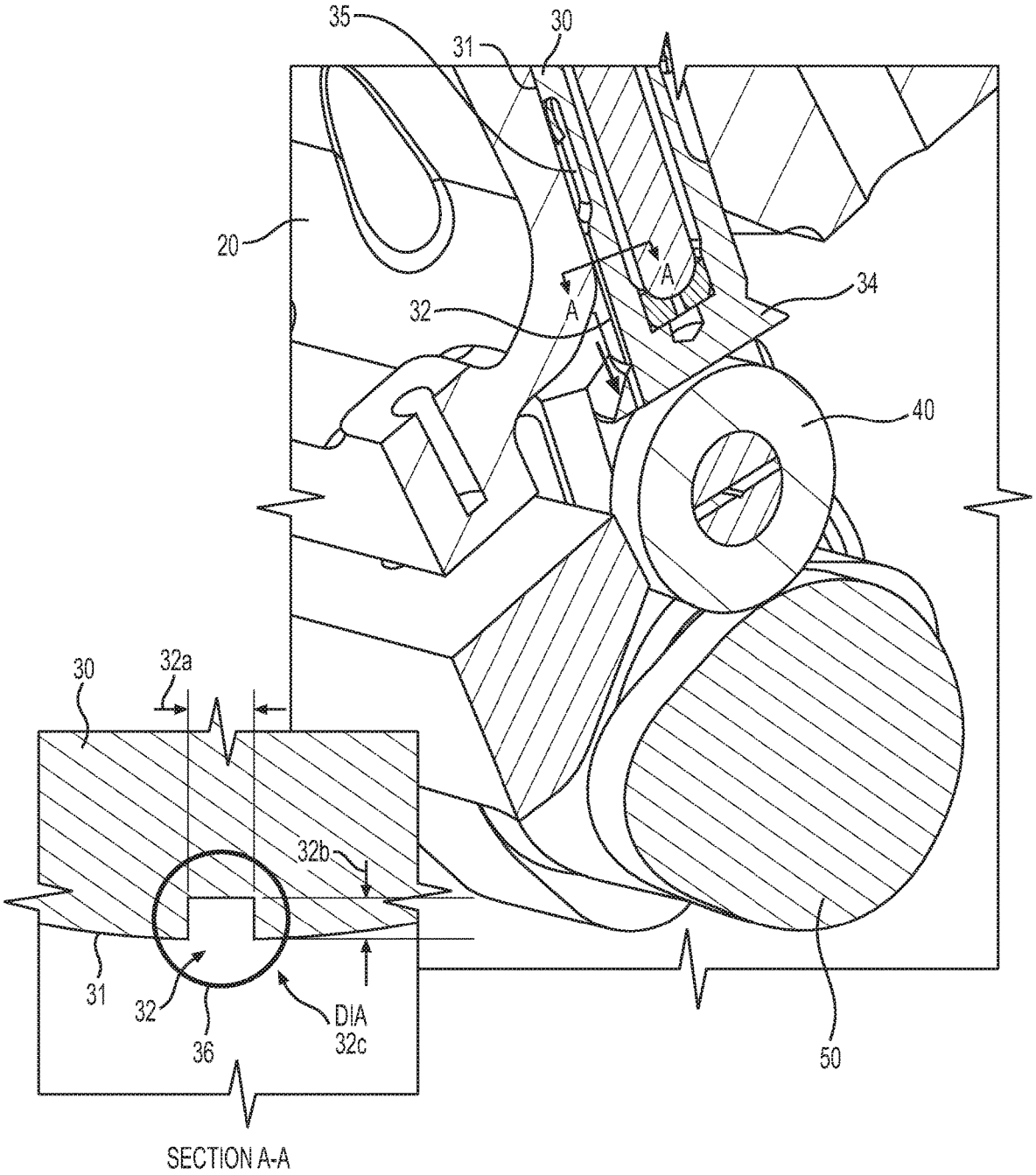
FIGS. 1A, 1B, 2A, 2B, and 2C are different views of an exemplary disclosed lifter of a cam follower assembly in contact with a cam lobe of a camshaft.
Figure 1B:
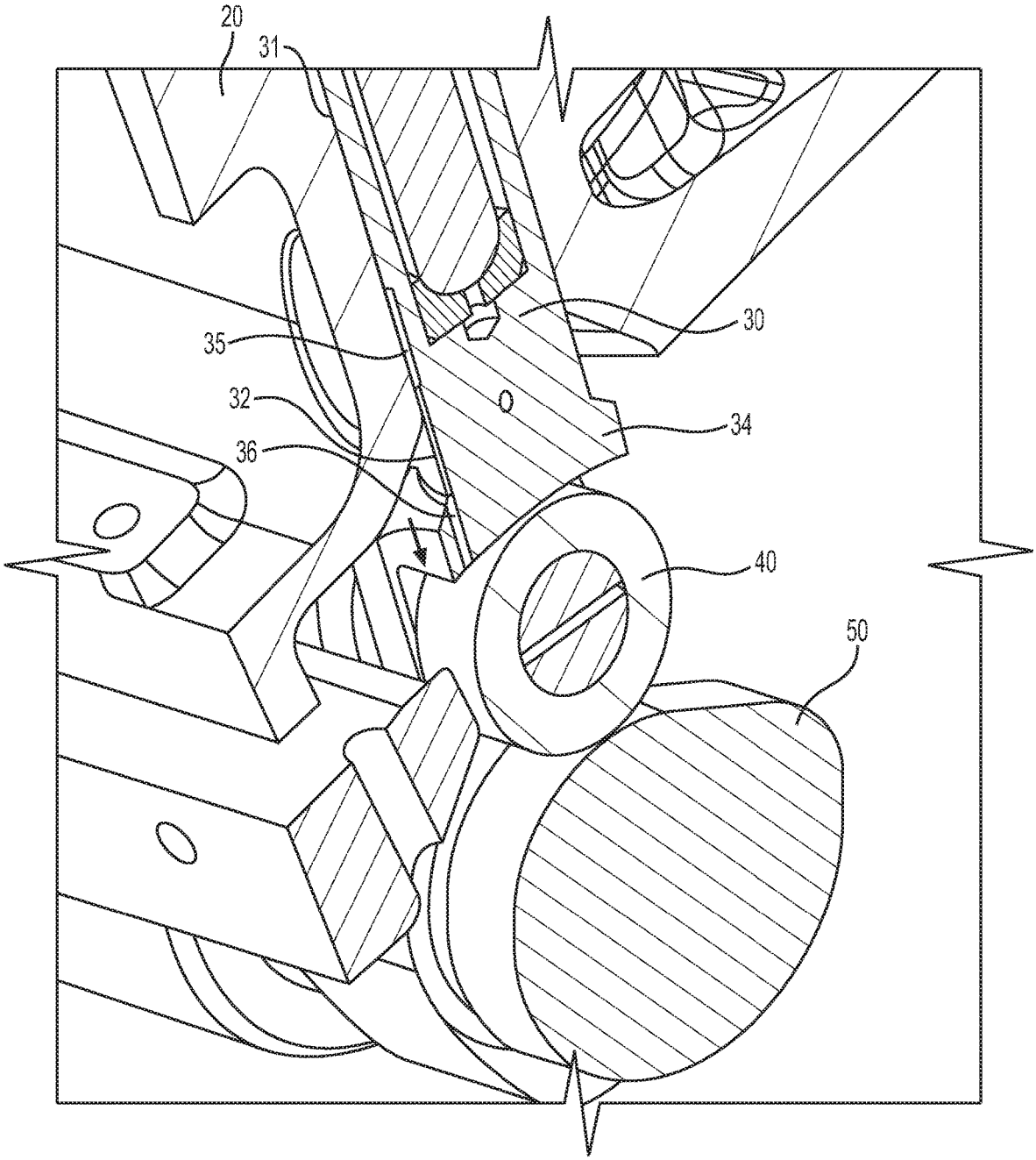
Figure 2A:
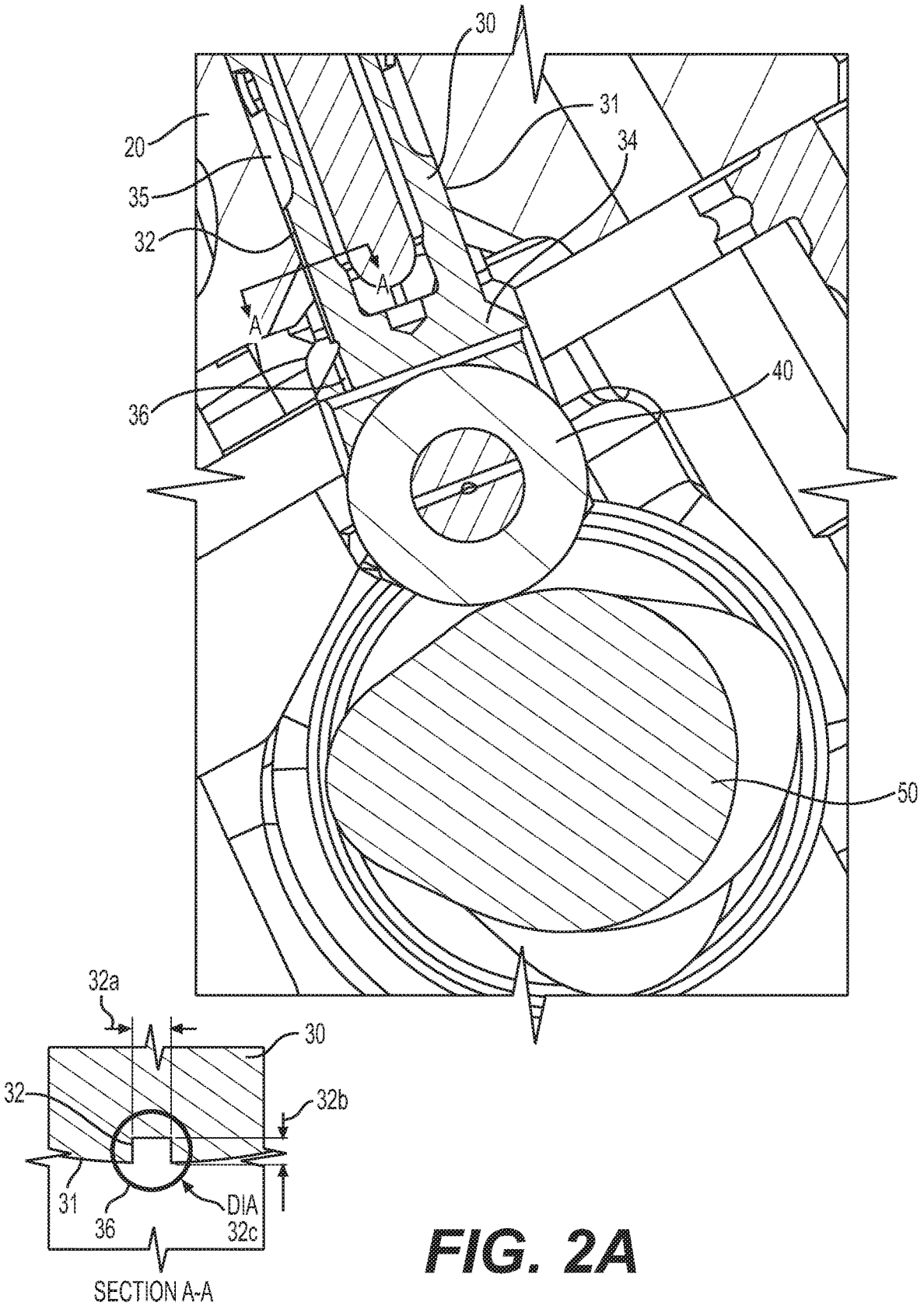
Figure 2B:
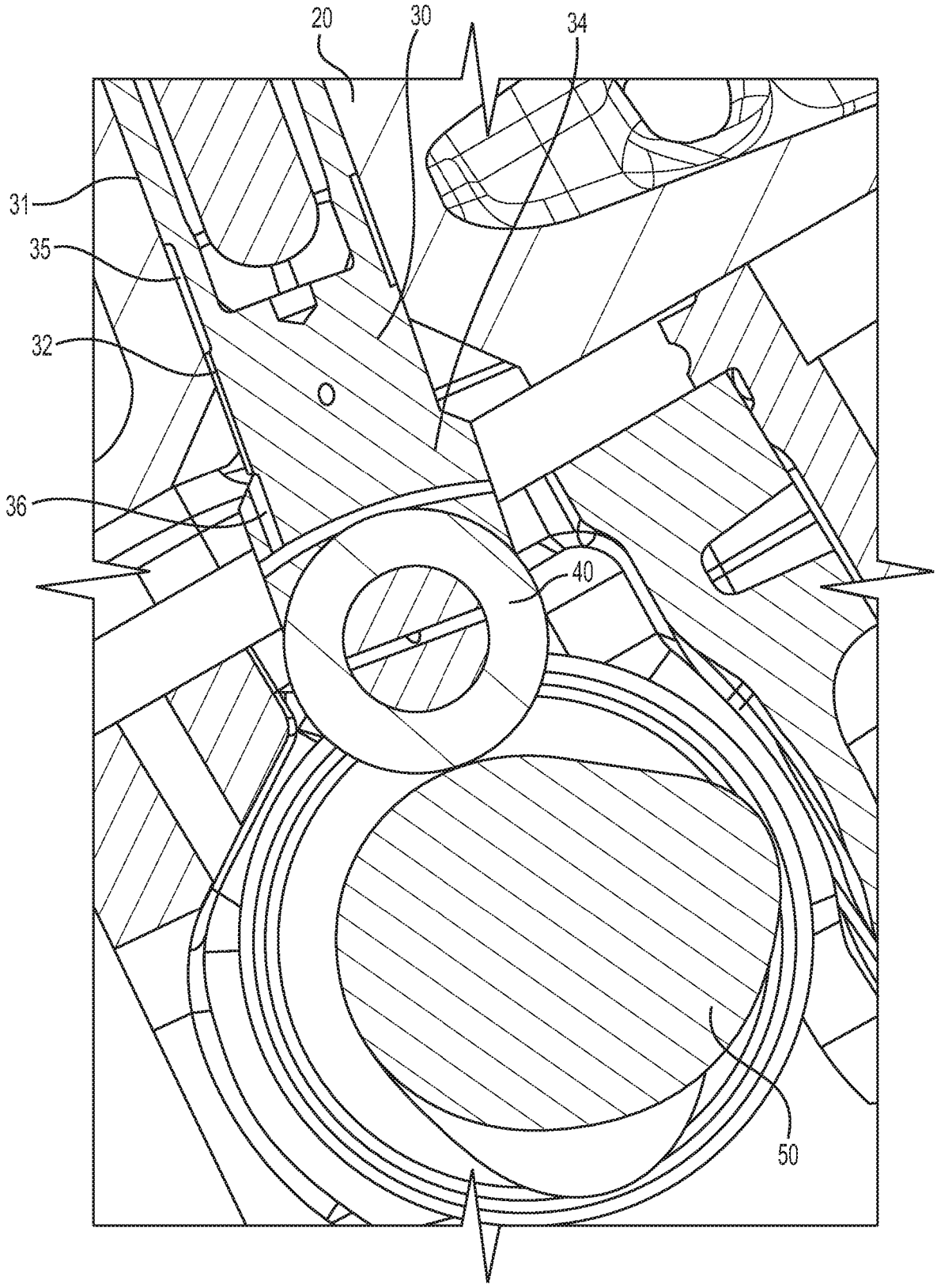
Figure 2C:
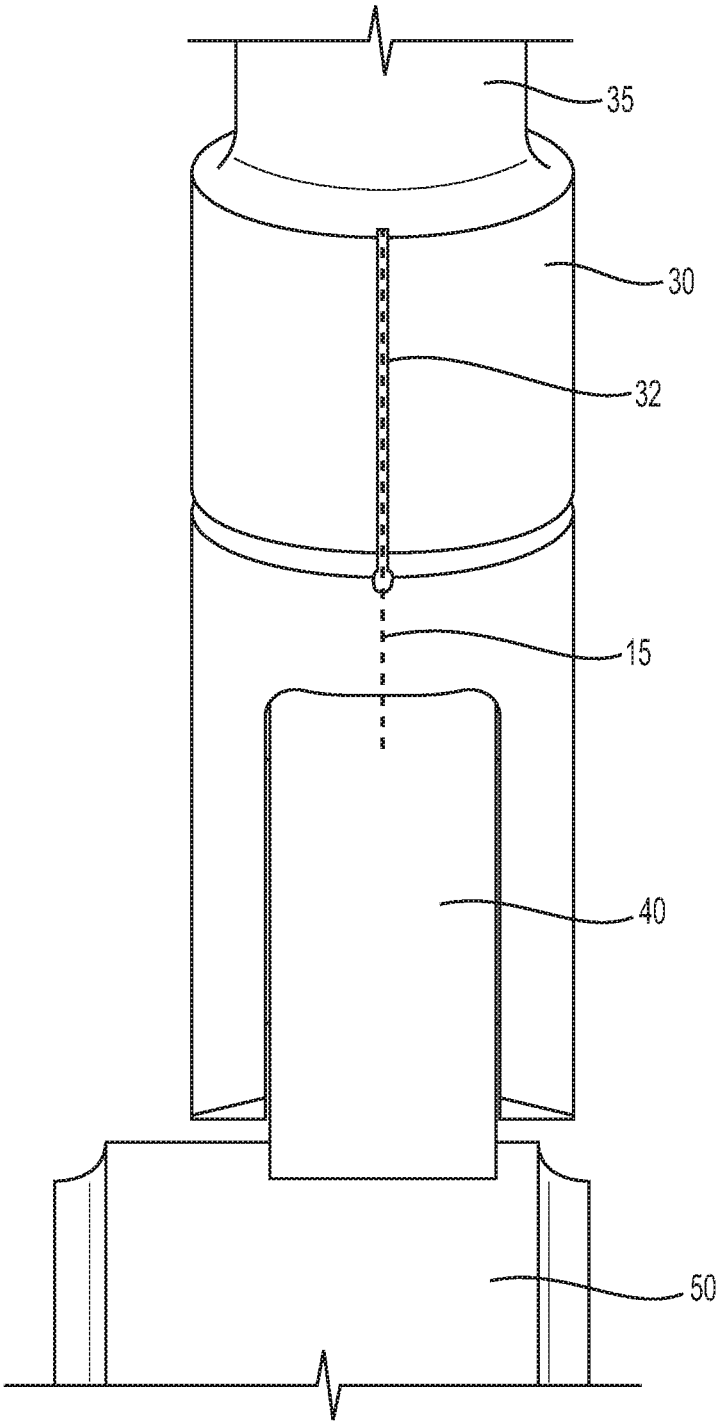
Figure 3B:
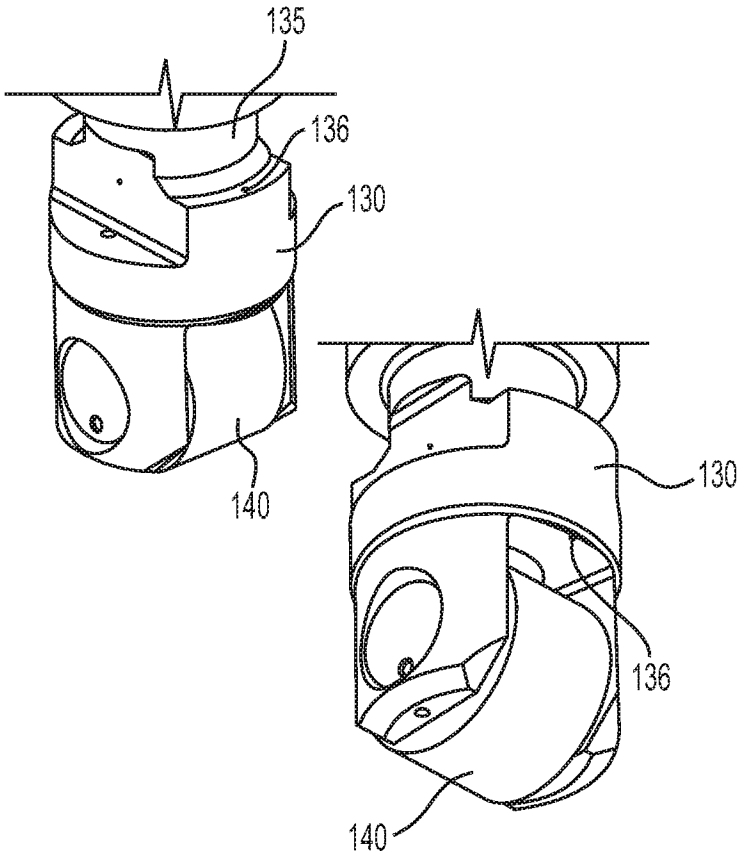
FIGS. 3A, 3B, 4A, and 4B are different views of another exemplary disclosed lifter of a cam follower assembly that contacts a cam lobe of a camshaft.
Figure 3A:
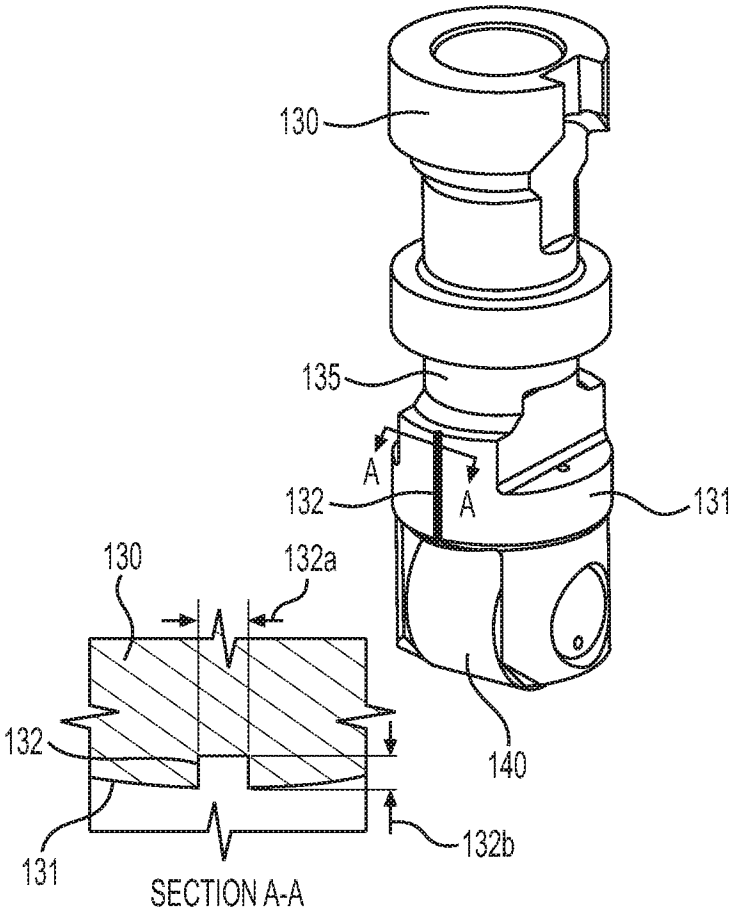

FIGS. 1A, 1B, 2A, 2B, and 2C illustrate an exemplary embodiment of a valve lifter 30 slidably supported in an engine block 20. FIGS. 3A, 3B, 4A, and 4B illustrate another exemplary embodiment of a valve lifter 130. FIGS. 5A, 5B, 5C, 5D, and 6 illustrate yet another exemplary embodiment of a fuel system lifter 230 that may be used in control of a fuel injector of a fuel pump. Each of the embodiments of a lifter configured to be slidably reciprocated within a bore of an engine component, such as an engine block or a fuel pump housing, is operable to open and close an associated flow control component of an engine. Valve lifters 30, 130 may be operative to cause the timed opening and closing of intake and exhaust valves of the engine, while fuel system lifter 230 may be operative to cause the timed opening and closing of a fuel injector.

A valve lifter as used in an internal combustion engine is designed to translate the angular motion of a camshaft to reciprocating motion to open and close intake and exhaust valves of the engine. In the exemplary embodiment of FIGS. 1A, 1B, 2A, 2B, and 2C, valve lifter 30 of an exemplary cam follower assembly includes a cam roller 40 that rides on a cam lobe 50 of a camshaft to translate the rotational motion of the camshaft into a reciprocating motion. The valve lifter is typically machined from high strength stainless steel alloys such as 4130, 4140 or SAE 9310. In a pushrod engine, the valve lifter receives a pushrod which moves up and down with the valve lifter. One end of the pushrod may be received into a cavity extending into one longitudinal end of the valve lifter. The opposite end of the pushrod may be engaged with a rocker arm that acts upon a valve. The valve, which may be an intake valve or an exhaust valve, may be positioned in a valve spring, which is situated in a cylinder head that has intake and exhaust openings above the cylinder in which the valves are seated. The cylinder head receives a mixture of air and fuel via an intake manifold from either a fuel injection system or carburetor. When an intake valve opens, the air-fuel mixture passes through the intake port and enters the cylinder for combustion. The resulting spent gases are expelled from the combustion chamber when the exhaust valve opens. The openings and closings of the valves are controlled by the movement of the cam lobes on the camshaft, which is translated from rotation of the cam lobes into reciprocating motion by the associated valve lifters riding on each cam lobe, and the pushrods received by each valve lifter. As each valve lifter and associated pushrod move upward, a rocker arm operatively connected to an end of the pushrod forces the associated valve downward, or open. Conversely, as the valve lifter and pushrod move downward, the rocker arm allows the valve 20 to travel upward to a closed position as a result of the biasing force of the valve spring.

As shown in FIG. 1A, valve lifter 30 is positioned in a lifter bore in engine block 20, with outer peripheral surface 31 of valve lifter 30 slidably reciprocating within the lifter bore as a camshaft with a plurality of cam lobes 50 rotates. Valve lifter 30 receives oil from a common oil passageway in engine block 20 that communicates with the lifter bore. Valve lifter 30 may include a generally cylindrical body having outer peripheral surface 31 configured to be reciprocally slidable within a bore of an engine component such as engine block 20 or a housing of a fuel injection pump of a fuel supply system. Cam roller 40 may be rotatably mounted at one end of the body of valve lifter 30, opposite from the end of valve lifter 30 engaged with a pushrod. In some configurations, cam roller 40 may be rotatably supported on a pin extending transversely to a central longitudinal axis of valve lifter 30. Cam roller 40 may be rotatably supported on the pin in between two bifurcated ends of the body of valve lifter 30, and configured to engage with cam lobe 50 on a camshaft of the engine. Cam lobe 50 may be operative to drive the body of valve lifter 30 to a position at which the cam follower assembly causes one of opening of a valve or actuation of a fuel injector of the engine.

As best seen in the inset of FIG. 1A, showing a sectional view of valve lifter 30 in the direction of arrows A-A, a groove 32 may be formed in the body of valve lifter 30 inset from outer peripheral surface 31 and extending axially along outer peripheral surface 31 parallel to the longitudinal axis of the body and aligned with an axial median plane of at least one of cam roller 40 or cam lobe 50. As shown in the exemplary embodiment of FIG. 2C, a dashed line illustrates the oil flow path 15 of a lubricant that passes through groove 32 extending axially along outer peripheral surface 31 of the body of valve lifter 30. Groove 32, and hence oil flow path 15 of the lubricant flowing along groove 32, is aligned with an axial median plane that intersects cam roller 40, perpendicular to a central axis of rotation of cam roller 40, and at a median point midway between the two axial ends of cam roller 40.

Groove 32 of lifter 30 for the exemplary cam follower assembly shown in FIGS. 1A, 1B, 2A, 2B, and 2C has a substantially rectangular cross section, as best seen in the inset of FIG. 1A. In the exemplary embodiment shown in the figures, groove 32 has a width 32*a* that is greater than a depth 32*b* of groove 32. Dimensions 32*a*, 32*b* of groove 32 may be selected as a function of factors that may include a length of groove 32, and the average pressure expected for a lubricant that will enter groove 32 and flow along groove 32 until exiting groove 32 to be deposited onto at least one of cam roller 40 or cam lobe 50. The dimensions of groove 32 determine the cross sectional area and wetted perimeter of the lubricant flow passageway created by groove 32, and hence determine fluid flow characteristics such as head loss, flow rate, and pressure drop for lubricant flowing through groove 32. In one embodiment, groove 32 may be provided with a width of approximately 0.8 mm and a depth of approximately 0.5 mm, as determined within normal machining tolerances. One of ordinary skill in the art will recognize that groove 32 may have other cross sectional configurations than the substantially rectangular cross section shown in the exemplary embodiments. Alternative configurations may include a semi-circular cross section, or any other configuration that provides the desired cross sectional area and wetted perimeter of the lubricant passageway created by groove 32 in order to provide the desired flow characteristics for lubricant flowing along groove 32.

In the exemplary embodiment of valve lifter 30 shown in FIGS. 1A, 1B, 2A, 2B, and 2C the body of lifter 30 may include a frustoconical-shaped flared lower portion 34 adjacent cam roller 40 and at the opposite end of lifter 30 from the end that receives an end of a pushrod. As a result of flared lower portion 34 in this particular exemplary embodiment of valve lifter 30, groove 32 is coextensive with a bore hole 36 extending through flared lower portion 34 in a direction substantially parallel to the central longitudinal axis of the body of valve lifter 30. Bore hole 36 may be provided with a diameter 32*c* and cross sectional area that is at least as large as the cross sectional area of groove 32 so as to not introduce any additional flow restrictions or pressure drop to the flow of lubricant passing through groove 32 on its way along oil flow path 15 to be directly deposited on at least one of cam roller 40 or cam lobe 50.

One of ordinary skill in the art will recognize that valve lifter 30 may be symmetrical in configuration as viewed from 360 degrees around the cylindrical body of valve lifter 30, with the exception of groove 32 and bore hole 36, which are located only on one side of the body of valve lifter 30 in the embodiment shown in FIGS. 1A, 1B, 2A, 2B, and 2C. Moreover, an alternative embodiment of valve lifter 30 may include groove 32 and bore hole 36 located on the opposite side of the valve lifter body, at a position spaced 180 degrees around the valve lifter body from the position illustrated in the exemplary embodiment of FIGS. 1A, 1B, 2A, 2B, and 2C. Another alternative embodiment may include two grooves, spaced 180 degrees from each other on opposite sides of the valve lifter body, with each of the grooves being coextensive with a corresponding bore hole through flared lower portion 34.

Figure 4A:
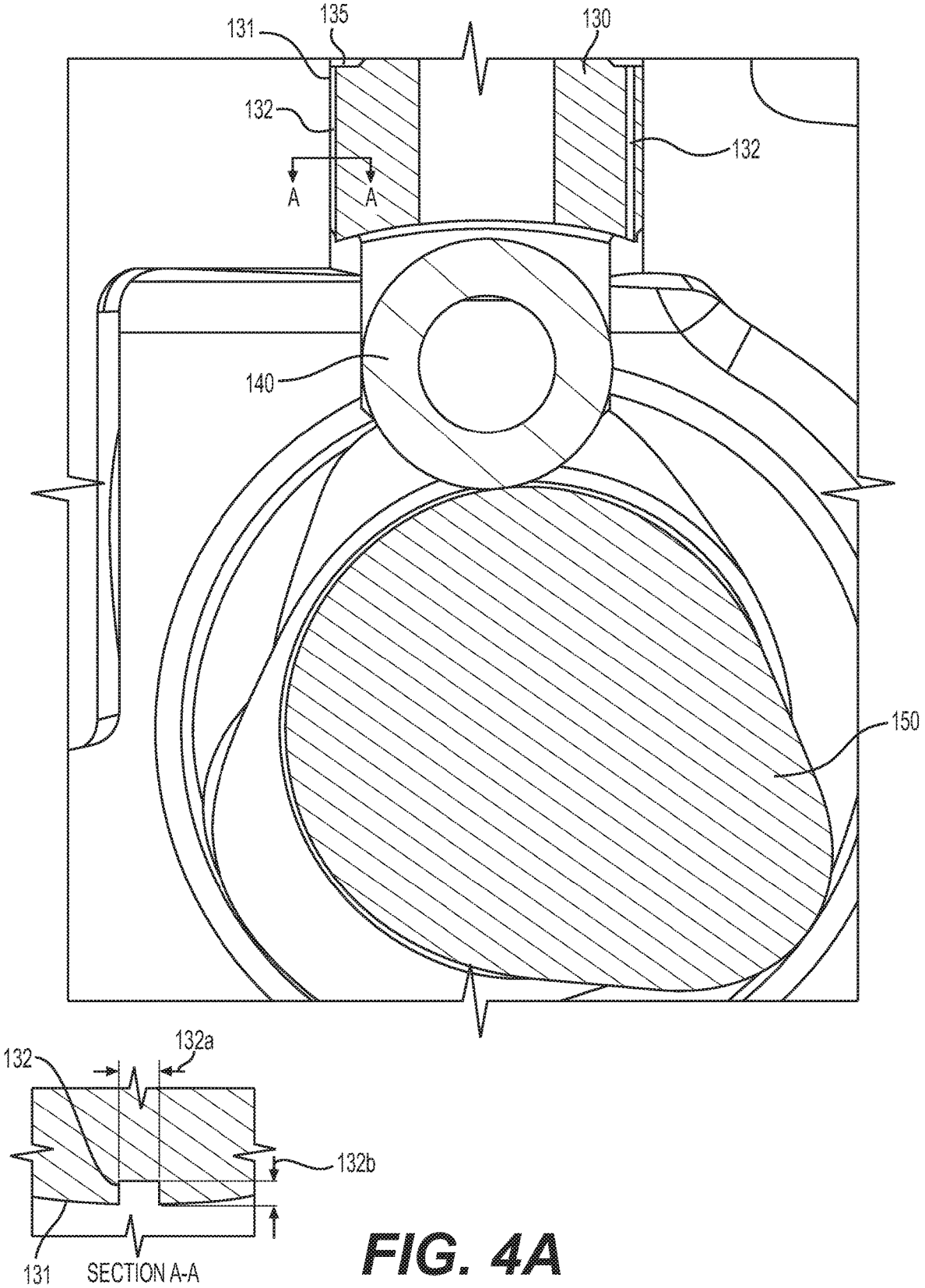
Figure 4B:
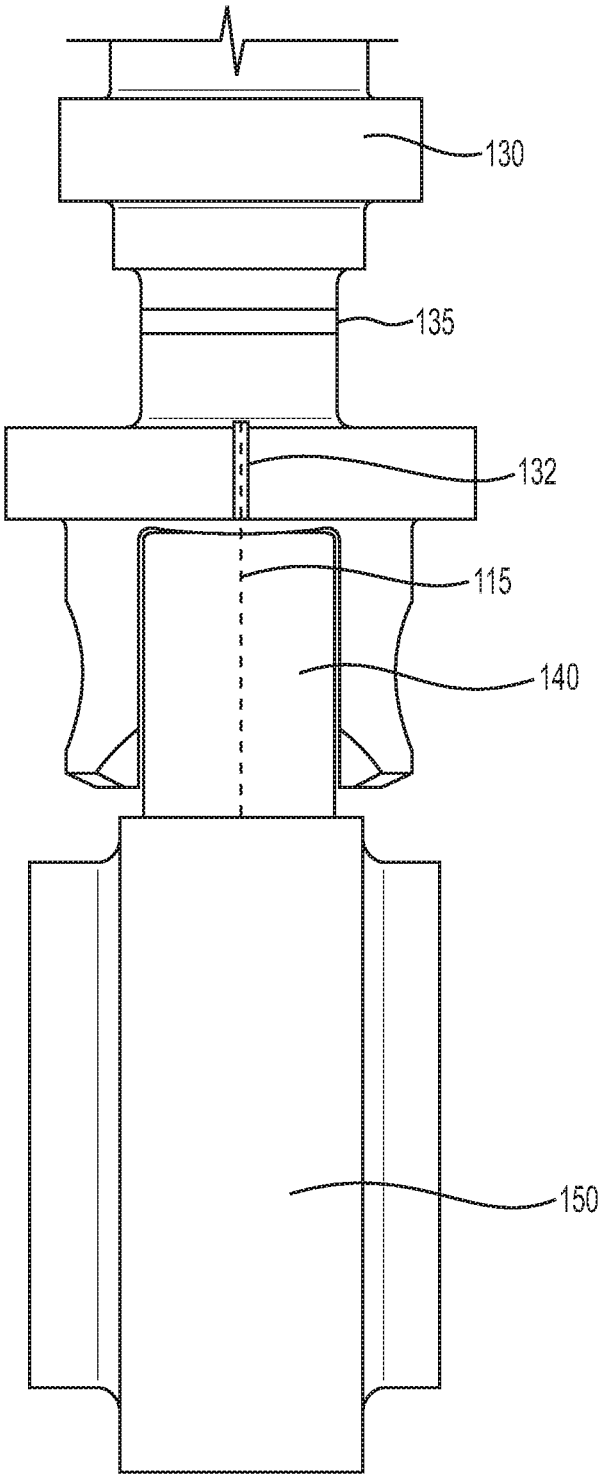
Figure 5B:
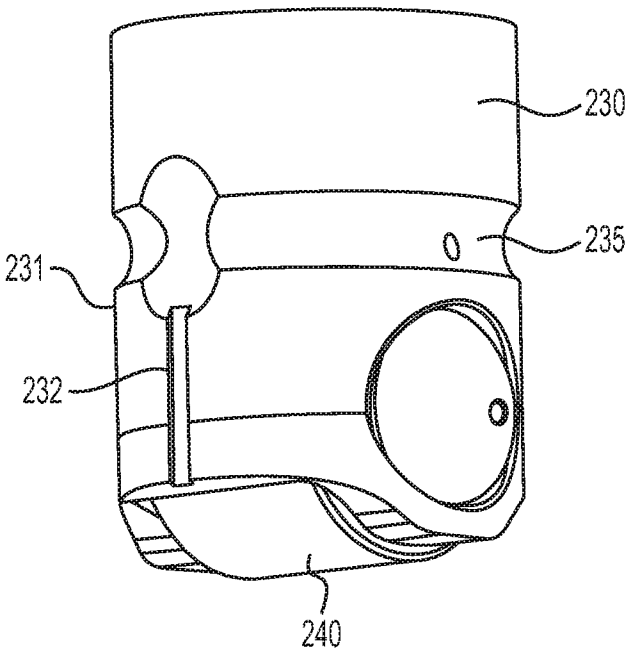
FIGS. 5A, 5B, 5C, 5D, and 6 are different views of yet another exemplary disclosed lifter of a cam follower assembly that contacts a cam lobe of a camshaft.
Figure 5A:
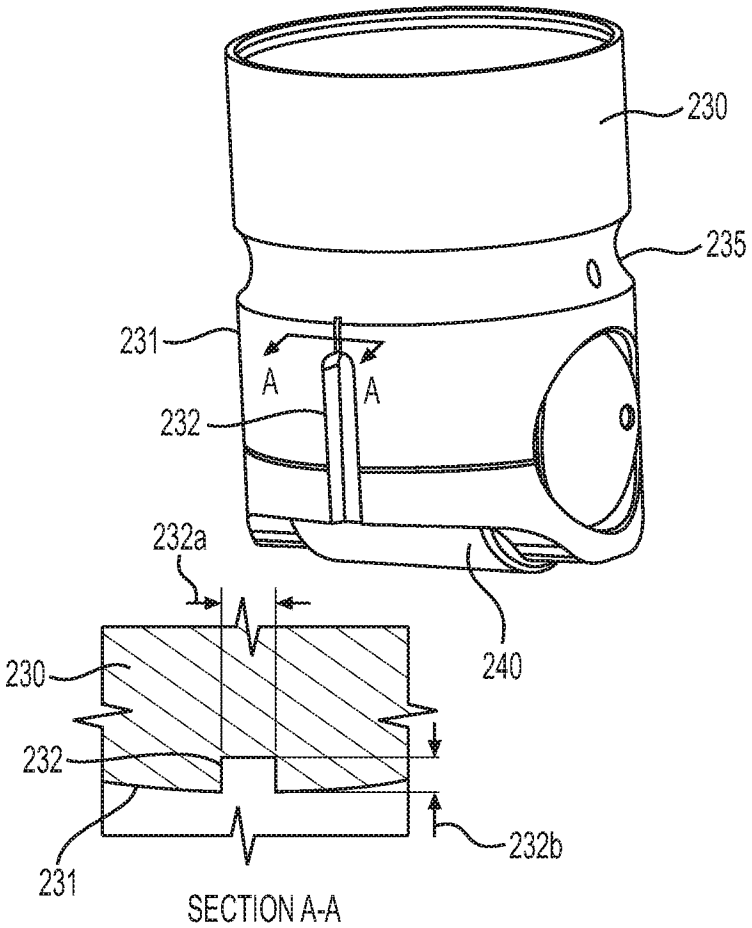
Figure 5D:
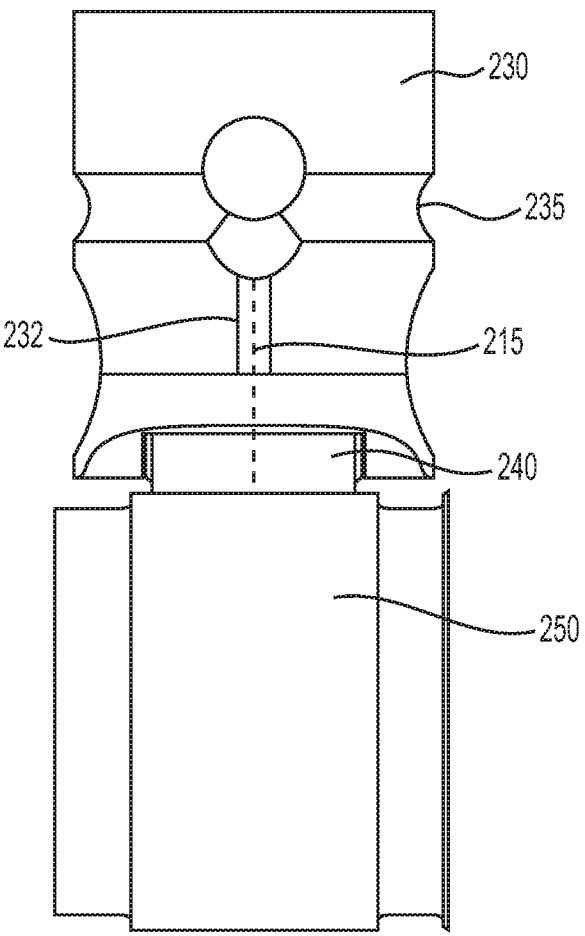
Figure 5C:
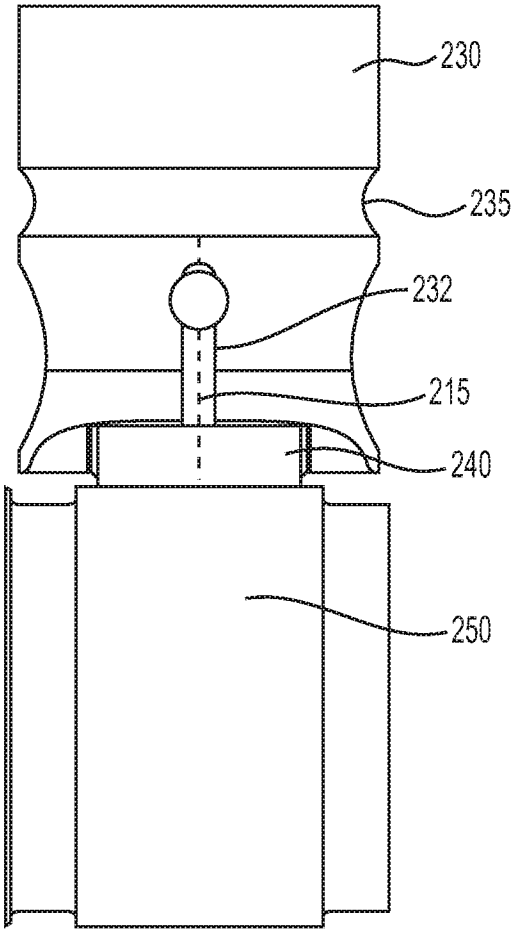
Figure 6:
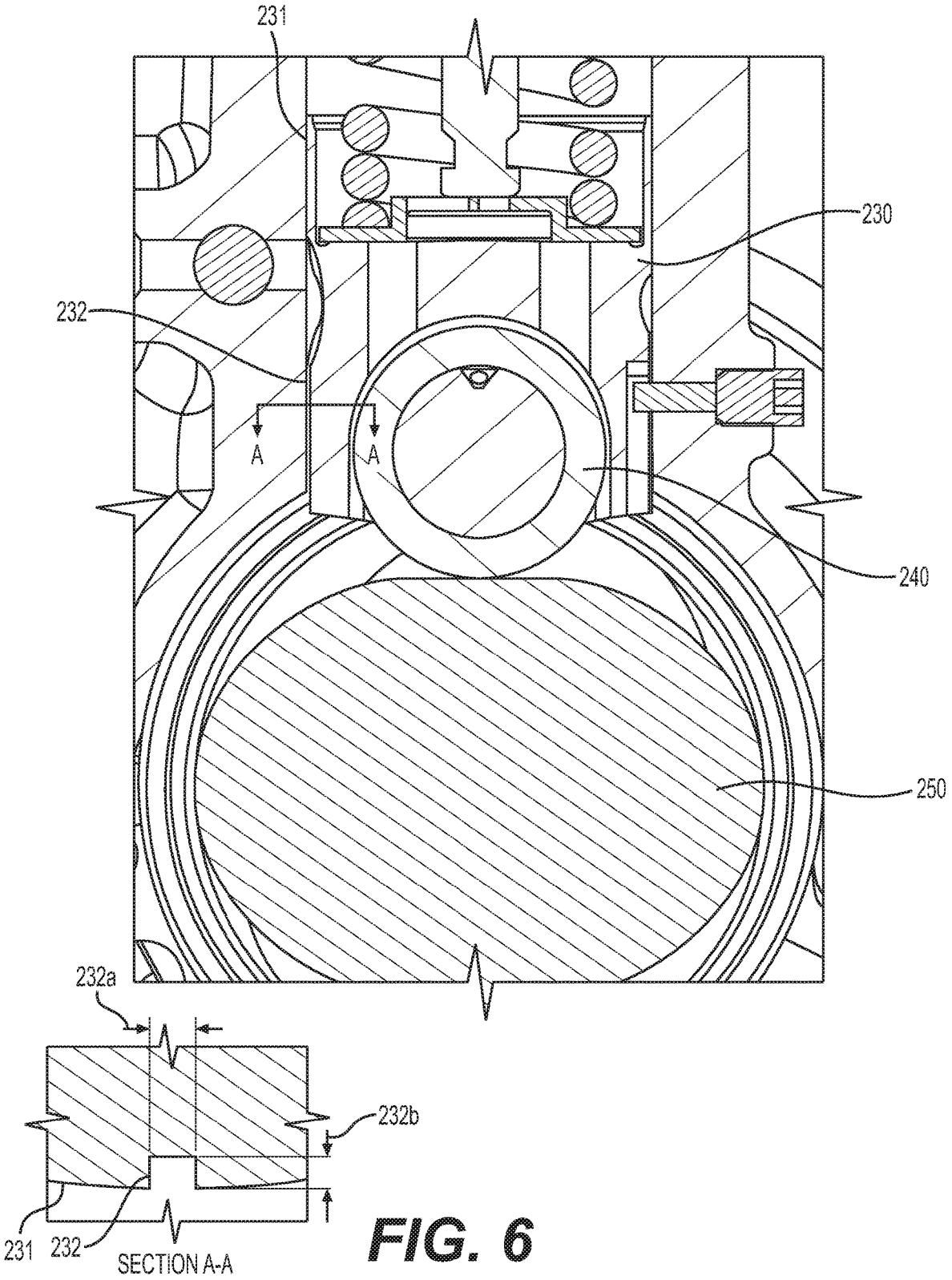

While the exemplary embodiments of the cam follower assemblies shown in FIGS. 1A-2C, and FIGS. 3A-4B may include valve lifters 30, 130 operative to effect the timed opening and closing of intake and exhaust valves in an internal combustion engine, the embodiment of a cam follower assembly shown in FIGS. 5A-6 includes a fuel system lifter 230 operative to effect the timed actuation of a fuel injector configured to inject fuel into one of an intake port leading to a cylinder or directly into a cylinder of an internal combustion engine. Therefore, the engine components in which lifter bores configured to receive lifters 30, 130 are formed may be engine blocks, while the engine components in which lifter bores configured to receive lifter 230 are formed may be fuel pump housings. Oil supply passageways through engine block 20 or through a fuel pump housing of a fuel system on an engine may be configured to intersect with the lifter bores within which lifters 30, 130, 230 are reciprocally slidable.

As shown in FIGS. 1A-2C, the body of exemplary valve lifter 30 may include an oil receiving annular recess 35 formed around outer peripheral surface 31 of the body of valve lifter 30 at a location spaced from cam roller 40 and in fluid communication with one end of groove 32. Oil receiving annular recess 35 may be configured to receive oil from an oil supply passageway of engine block 20 while the body of valve lifter 30 is reciprocally sliding within the lifter bore of engine block 20. Oil received within oil receiving annular recess 35 of valve lifter 30 then flows into groove 32 under pressure generated by the oil pressure in the oil supply passageway through engine block 20 and by the reciprocal sliding movement of valve lifter 30 within the lifter bore of engine block 20. As illustrated by the dashed line in FIG. 2C, oil flow path 15 leads directly from groove 32 and coextensive bore hole 36 to an axial median plane of cam roller 40 at a midpoint between opposite axial ends of cam roller 40, such that oil is directly deposited on the highest load area of cam roller 40. In the alternative embodiments of valve lifter 30 discussed above, with a groove and coextensive bore hole located on an opposite side of the valve lifter body, or with two grooves and coextensive bore holes located on both of opposite sides of the valve lifter body spaced 180 degrees apart from each other, the oil flow path 15 from each of the one or more grooves and coextensive bore holes may still lead directly to an axial median plane of cam roller 40 at a midpoint between opposite axial ends of cam roller 40, such that oil is directly deposited on the highest load area of cam roller 40.

In the alternative embodiment of a cam follower assembly shown in FIGS. 3A-4B, and as best seen in FIG. 4B, an oil flow path 115 from groove 132 of valve lifter 130 may follow groove 132 extending parallel to the central longitudinal axis of valve lifter 130 from an oil receiving annular recess 135 formed around the outer peripheral surface 131 of valve lifter 130 and exiting from an end of valve lifter 130 to be deposited directly along an axial median plane of cam lobe 150. FIG. 3B shows an alternative embodiment to FIG. 3A, in which groove 132 of valve lifter 132 is replaced with a bore hole 136 through a portion of the body of valve lifter 130. Bore hole 136 may extend parallel to the central longitudinal axis of valve lifter 130 from oil receiving annular recess 135 formed around the outer peripheral surface 131 of valve lifter 130 such that oil passing through bore hole 136 exits from an end of valve lifter 130 to be deposited directly along an axial median plane of cam lobe 150. Bore hole 136 may be provided with a diameter and cross sectional area that is at least as large as the cross sectional area of groove 132 in the alternative embodiment discussed above so as to not introduce any undesirable flow restrictions or pressure drop to the flow of lubricant passing through bore hole 136 on its way along oil flow path 115 to be directly deposited on at least one of cam roller 140 or cam lobe 150.

One of ordinary skill in the art will recognize that valve lifter 130 shown in FIGS. 3A-4B may be symmetrical in configuration as viewed from 360 degrees around the cylindrical body of valve lifter 130, with the exception of groove 132 or bore hole 136, which are located only on one side of the body of valve lifter 130 in the exemplary embodiment shown in FIGS. 3A-4B. Moreover, an alternative embodiment of valve lifter 130 may include groove 132 or bore hole 136 located on the opposite side of the valve lifter body, at a position spaced 180 degrees around the valve lifter body from the position illustrated in the exemplary embodiment. Another alternative embodiment may include two grooves, two bore holes, or a groove and a bore hole, spaced 180 degrees from each other on opposite sides of the valve lifter body.

In the alternative embodiments of valve lifter 130 discussed above, with a groove or bore hole located on an opposite side of the valve lifter body, or with two grooves and/or bore holes located on both of opposite sides of the valve lifter body spaced 180 degrees apart from each other, the oil flow path from each of the one or more grooves or bore holes may still lead directly to an axial median plane of cam roller 140 at a midpoint between opposite axial ends of cam roller 140, such that oil is directly deposited on the highest load area of cam roller 140.

Similarly, in the exemplary embodiment of a cam follower assembly for a fuel system lifter 230 shown in FIGS. 5A-6, an oil flow path 215 from a groove 232 of fuel system lifter 230 may follow groove 232 extending parallel to the central longitudinal axis of fuel system lifter 230. Oil flow path 215 may extend from an oil receiving annular recess 235 formed around the outer peripheral surface 231 of fuel system lifter 230 and exit from an end of fuel system lifter 230 to be deposited directly along an axial median plane of a cam lobe 250.

One of ordinary skill in the art will recognize that fuel system lifter 230 may be symmetrical in configuration as viewed from 360 degrees around the cylindrical body of fuel system lifter 230, with the exception of groove 232, which is located only on one side of the body of fuel system lifter 230 in the embodiment shown in FIGS. 5A-6. Moreover, an alternative embodiment of valve lifter 230 may include groove 232 located on the opposite side of the valve lifter body, at a position spaced 180 degrees around the valve lifter body from the position illustrated in the exemplary embodiment. Another alternative embodiment may include two grooves, spaced 180 degrees from each other on opposite sides of the fuel system lifter body.

Each of exemplary lifters 30, 130, 230 includes a rotatably mounted cam roller 40, 140, 240, respectively, which rides on an engagement surface of cam lobe 50, 150, 250, respectively, of a camshaft that rotates along with a crankshaft as pistons of the engine move up and down. In various exemplary embodiments, cam rollers 40, 140, 240 may include bearing assemblies containing needle bearings, roller bearings, or bushings. Each of cam rollers 40, 140, 240 may be rotatably mounted to a respective valve lifter 30, 130, 230 by a shaft or pin extending through the bearings or bushings of the cam roller. In high performance and heavy duty application engines, especially those which maintain high engine speeds or loads for long durations, it is important to provide sufficient oiling of the cam rollers of the lifters and of the cam lobes of the camshaft as the lifters ride on the cam lobes, particularly at the point of contact, and even more particularly in the area of highest load. The highest load areas at the point of contact between the cam rollers and the cam lobes are typically located at or near the axial median planes extending through each cam roller and cam lobe, perpendicular to the central rotational axes of the cam roller and the cam lobe, and intersecting the axes at approximately a midpoint between the two opposite axial ends of the cam roller and the cam lobe. Oil receiving annular recesses 35, 135, 235 formed around the outer peripheral surfaces 31, 131, 231 of lifters 30, 130, 230, respectively, form oil pressure feed passageways that supply oil to grooves 32, 132, 232. Grooves 32, 132, 232 form oiling channels that are inset from outer peripheral surfaces 31, 131, 231 of lifters 30, 130, 230, and extend axially along the outer peripheral surfaces parallel to the longitudinal axes of the bodies of the lifters and aligned with an axial median plane of the cam roller and the cam lobe. Oil enters oil receiving annular recesses 35, 135, 235 from common transverse oil passageways in engine block 20 or the fuel pump housing that intersect the lifter bores. As the lifters reciprocate, the oil receiving annular recesses carry oil up and down the lifter bores and direct oil into the oiling channels formed by grooves 32, 132, 232 for supplying the oil directly to the engagement interface between each cam roller and cam lobe.

An engine in which fuel system lifters 230 are provided may include an engine block 20 that at least partially defines a plurality of cylinders. A piston may be slidably disposed within each cylinder to reciprocate between a top-dead-center position and a bottom-dead-center position, and a cylinder head may be associated with each cylinder. Each cylinder, piston, and cylinder head may together at least partially define a combustion chamber. A fuel injector assembly may be at least partially disposed within each cylinder head and configured to inject fuel into each respective combustion chamber to support fuel combustion within the engine. The engine may also include a crankshaft that is rotatably supported within engine block 20 by way of a plurality of journal bearings. A connecting rod may connect each piston to the crankshaft so that a sliding motion of the piston within each respective cylinder results in a rotation of the crankshaft.

A fuel injector assembly may be configured to inject or otherwise spray fuel, for example, diesel fuel, directly into each combustion chamber via a fuel port within the cylinder head in accordance with a desired timing. The fuel injector assembly may embody a mechanically-actuated, electronically-controlled unit injector that is in fluid communication with a common fuel rail (not shown). Alternatively, the fuel injector assembly may be any common rail type injector and may be actuated and/or operated hydraulically, mechanically, electrically, piezo-electrically, or any combination thereof. The common fuel rail may provide fuel to the fuel injector assembly associated with each combustion chamber.

Just as with flow control components of the engine in the form of the intake and exhaust valves, the fuel injector assemblies may be driven by a rocker arm that is pivotally coupled to a rocker shaft. Each fuel injector assembly may include an injector body, a plunger, and an injector tip. A first end of the rocker arm may be operatively coupled to the plunger of the fuel injector. The plunger of the fuel injector may be biased by a spring toward a first end of the rocker arm. In the exemplary embodiment shown in FIGS. 5A-6, a second end of a rocker arm may be operatively coupled to a camshaft through fuel system lifter 230. More specifically, fuel system lifter 230 may be disposed in operative connection between cam lobe 250 of a camshaft and the injector rocker arm. Cam lobe 250 may have an outer profile that determines, at least in part, the fuel injection timing of the fuel injector assembly during operation of the engine. The camshaft may be operably connected to the crankshaft, for example, directly, by way of a gear train, and/or with a variable timing device. In this manner, the crankshaft may drive the camshaft to rotate at a corresponding speed. Cam lobe 250 may be moved into and out of contact with fuel system lifter 230 during rotation of the camshaft to provide injections of fuel at predetermined crank angles.

INDUSTRIAL APPLICABILITY

The disclosed cam follower assemblies and lifters may be used with any internal combustion engine. The lifters of this disclosure facilitate methods of supplying oil to high load areas on at least one of a cam roller of a lifter or a cam lobe of a camshaft including cams that cause reciprocating movement of the lifter and flow control components of an engine. Each of the disclosed exemplary lifters may include a generally cylindrical body having an outer peripheral surface configured to be reciprocally slidable within a bore of an engine component. The disclosed cam rollers are rotatably mounted on the body of each lifter, at an opposite end of the lifter from an end that receives a pushrod configured to exert a force on a rocker arm operatively connected to a flow control component of an engine. Each cam roller is configured to engage with a corresponding cam lobe of a cam shaft, and the cam lobe is operative to drive the body of the lifter to a position at which the lifter causes movement of at least one of the flow control components through the pushrod and rocker arm assembly.

The disclosed methods of supplying oil to high load areas on at least one of a cam roller of a lifter or a cam lobe of a camshaft may include receiving oil from an oil supply passageway of the engine component into an oil receiving annular recess formed around the outer peripheral surface of the body of the lifter at a location spaced from the cam roller while the body is reciprocally sliding within the lifter bore of the engine component. Oil is then directed from the oil receiving annular recess into an oiling channel formed in the body inset from the outer peripheral surface and extending axially along the outer peripheral surface parallel to the longitudinal axis of the body and aligned with an axial median plane of the cam roller and the cam lobe. The location and cross sectional area of the oiling channel or groove formed along the outer peripheral surface of the lifter ensures that sufficient oil is supplied from the oil supply passageways of the engine component with negligible pressure drop directly to the high load interface between the cam roller and the engaged cam lobe. As discussed above, various alternative embodiments may include one oiling channel or groove, possibly coextensive with a bore hole through a portion of a lifter, or replaced by a bore hole through a portion of the lifter body, located on only one side of an otherwise symmetrical lifter body, or two oiling channels or grooves, possibly coextensive with one or more bore holes, or replaced by one or more bore holes through portions of the lifter body, and formed along the outer peripheral surface of the lifter body on opposite sides of the lifter body spaced 180 degrees from each other.

Each groove or oiling channel 32, 132, 232 of lifters 30, 130, 230, respectively, defines an oil flow path 15 that extends parallel to the longitudinal axis of the respective lifter and intersects with an axial median plane of at least one of cam roller 40, 140, 240, respectively, or cam lobe 50, 150, 250, respectively. The axial median plane located approximately midway between opposite axial ends of the cam roller or the cam lobe is typically the highest load area at the interface between the lifter and the camshaft, and therefore the lifters according to the various embodiments of this disclosure have been found to greatly enhance the life expectancy of the lifters and camshafts by ensuring adequate lubrication at all times to the high load areas and dramatically reducing wear of the components.

It will be apparent to those skilled in the art that various modifications and variations can be made to the disclosed lifters and methods. Other embodiments will be apparent to those skilled in the art from consideration of the specification and practice of the disclosed system. It is intended that the specification and examples be considered as exemplary only, with a true scope being indicated by the following claims and their equivalents.

What is claimed is:

1. A cam follower assembly including a cam roller, the cam follower assembly comprising:

a generally cylindrical body having an outer peripheral surface configured to be reciprocally slidable within a bore of an engine component;

the body rotatably mounting the cam roller with the cam roller being configured to engage with a cam lobe on a camshaft of the engine, wherein the cam lobe is operative to drive the body to a position at which the cam follower assembly causes one of opening of a valve or actuation of a fuel injector of an engine; and a groove formed in the body, the groove being inset from the outer peripheral surface and extending axially along the outer peripheral surface parallel to a longitudinal axis of the body and aligned with an axial median plane of the cam roller and the cam lobe wherein the body further includes a flared lower portion adjacent to the cam roller, a transverse width of the flared lower portion extending beyond the outer peripheral surface along a transverse direction, the transverse direction being transverse to the longitudinal axis, wherein the flared lower portion defines a bore hole extending therethrough, and wherein the groove is coextensive with the bore hole along the transverse direction.

2. The cam follower assembly of claim 1, wherein the groove has a substantially rectangular cross section.

3. The cam follower assembly of claim 2, wherein the groove has a width that is greater than a depth of the groove.

4. The cam follower assembly of claim 3, wherein the groove has a width of approximately 0.8 mm and a depth of approximately 0.5 mm.

5. The cam follower assembly of claim 1, wherein the flared lower portion has a frustoconical-shape.

6. The cam follower assembly of claim 1, wherein the engine component is an engine block, and the groove is supplied with oil from an oil passage through the engine block.

7. The cam follower assembly of claim 1, wherein the engine component is a fuel supply system, and the groove is supplied with oil from an oil passage through a fuel pump housing of the fuel supply system.

8. The cam follower assembly of claim 1, wherein the body further includes an oil receiving annular recess formed around the outer peripheral surface of the body at a location spaced from the cam roller and in fluid communication with one end of the groove, the oil receiving annular recess being configured to receive oil from an oil supply passageway of the engine component while the body is reciprocally sliding within the bore of the engine component.

9. A lifter configured for use in an engine including a plurality of flow control components and a camshaft including cam lobes that cause reciprocating movement of the flow control components, the lifter comprising:

a generally cylindrical body having an outer peripheral surface configured to be reciprocally slidable within a bore of an engine component;

the body rotatably mounting a cam roller with the cam roller being configured to engage with a cam lobe on a camshaft of the engine, wherein the cam lobe is operative to drive the body to a position at which the lifter causes one of opening of a valve or actuation of a fuel injector of the engine; and an oiling channel formed in the body, the oiling channel being inset from the outer peripheral surface and extending axially along the outer peripheral surface parallel to a longitudinal axis of the body and aligned with an axial median plane of one or more of the cam roller and the cam lobe, wherein the body further includes a flared lower portion adjacent to the cam roller, a transverse width of the flared lower portion extending beyond the outer peripheral surface along a transverse direction, the transverse direction being transverse to the longitudinal axis, wherein the flared lower portion defines a bore hole extending therethrough, and wherein the oiling channel is coextensive with the bore hole along the transverse direction.

10. The lifter of claim 9, wherein the oiling channel has a substantially rectangular cross section.

11. The lifter of claim 10, wherein the oiling channel has a width that is greater than a depth of the oiling channel.

12. The lifter of claim 11, wherein the oiling channel has a width of approximately 0.8 mm and a depth of approximately 0.5 mm.

13. The lifter of claim 9, wherein the flared lower portion has a frustoconical shape.

14. The lifter of claim 9, wherein the engine component is an engine block, and the oiling channel is supplied with oil from an oil passage through the engine block.

15. The lifter of claim 9, wherein the engine component is a fuel supply system, and the oiling channel is supplied with oil from an oil passage through a fuel pump housing of the fuel supply system.

16. The lifter of claim 9, wherein the body further includes an oil receiving annular recess formed around the outer peripheral surface of the body at a location spaced from the cam roller and in fluid communication with one end of the oiling channel, the oil receiving annular recess being configured to receive oil from an oil supply passageway of the engine component while the body is reciprocally sliding within the bore of the engine component.

17. A method for supplying oil to a high load area on at least one of a cam roller of a lifter or a cam lobe of a camshaft including cams that cause reciprocating movement of the lifter and flow control components of an engine, wherein the lifter includes a generally cylindrical body having an outer peripheral surface configured to be reciprocally slidable within a bore of an engine component, the cam roller is rotatably mounted on the body and configured to engage with the cam lobe, and the cam lobe is operative to drive the body to a position at which the lifter causes movement of at least one of the flow control components, the method comprising:

receiving oil from an oil supply passageway of the engine component into an oil receiving annular recess formed around the outer peripheral surface of the body at a location spaced from the cam roller while the body is reciprocally sliding within the bore of the engine component; and directing the oil from the oil receiving annular recess into an oiling channel formed in the body, the oiling channel being inset from the outer peripheral surface and extending axially along the outer peripheral surface parallel to a longitudinal axis of the body and aligned with an axial median plane of one or more of the cam roller and the cam lobe wherein the outer peripheral surface extends from a first shoulder surface to a second shoulder surface, the first shoulder surface facing a longitudinal direction, the second shoulder surface facing away from the first shoulder surface along the longitudinal direction, the longitudinal direction being parallel to the longitudinal axis, wherein the oiling channel extends from the first shoulder surface to the second shoulder surface, and wherein the method further comprises directing the oil from the first shoulder surface to the second shoulder surface along the oiling channel.

18. The method of claim 17, wherein oil in the oiling channel is pressurized by oil pressure in the oil supply passageway of the engine component and by the reciprocal sliding motion of the body within the bore of the engine component such that the oil is delivered from the oiling channel directly onto at least one of the cam roller or the cam lobe at the axial median plane of the at least one of the cam roller or the cam lobe.

* * * * *